United States Patent [19]

Williams

[11] Patent Number: 4,525,021

[45] Date of Patent: Jun. 25, 1985

[54] ELECTRICAL CABLE CONNECTOR ASSEMBLY

[76] Inventor: Robert A. Williams, 2721 White Settlement Rd., Fort Worth, Tex. 76107

[21] Appl. No.: 544,709

[22] Filed: Oct. 24, 1983

[51] Int. Cl.[3] ..... H01R 13/58

[52] U.S. Cl. ..... 339/104

[58] Field of Search ..... 339/14 R, 22 R, 24, 339/89–90, 103 C, 104; 285/287; 174/83

[56] References Cited

U.S. PATENT DOCUMENTS

| | | | |
|---|---|---|---|
| 3,281,755 | 10/1966 | Trager | 339/89 R |
| 3,627,904 | 12/1971 | Milne | 174/83 |
| 3,646,496 | 2/1972 | Williams | 339/14 R |
| 4,295,672 | 10/1981 | Williams | 285/287 |

*Primary Examiner*—Eugene F. Desmond
*Attorney, Agent, or Firm*—Arthur F. Zobal

[57] ABSTRACT

An armored cable with a fitting at one end carries electrical leads which extend from the cable and the fitting and are connected to an electrical connector. A tubular body has a forward end adapted to be screwed to the connector such that its rear end is located near and forward of the fitting. A split ring or C-shaped ring is adapted to be located around the electrical leads with its forward end located within the tubular body such that a shoulder on the ring engages the rear end of the tubular body and the rear end of the ring engages the forward end of the fitting. A nut is adapted to be screwed to the rear of the tubular body and engage the fitting such that the fitting is securely held between the nut and the ring.

4 Claims, 6 Drawing Figures

ELECTRICAL CABLE CONNECTOR ASSEMBLY

DESCRIPTION OF THE PRIOR ART

U.S. Pat. No. 3,646,496 discloses an electrical cable connector having a separable ring along with a multifingered ring for confining the end of the outer shielding of an electrical cable.

SUMMARY OF THE INVENTION

It is an object of the present invention to provide a new and useful locking arrangement for securing in place the armored cable of a connector assembly.

The invention comprises an electrical connector, a hollow armored cable means, and a fitting having an opening formed therethrough connected to an end of said armored cable means. Said fitting has an enlarged forward end and a rear end with a shoulder formed therebetween facing the rear of said fitting. Electrical lead means extends through said armored cable means and through said fitting and is coupled to said connector. A body is provided having an opening formed therethrough. Said body has a forward end adapted to be removably coupled to said connector and a rear end to be located near and forward of said forward end of said fitting when said forward end of said body is coupled to said connector. Said electrical lead means extends through said opening of said body when said forward end of said body is coupled to said connector. Said opening of said body is large enough such that said body may be moved rearward of said fitting when said forward end of said body is uncoupled from said connector. Ring means is provided having a forward end and an enlarged rear end with a shoulder formed therebetween facing said forward end of said ring means. Said ring means is adapted to be located around said electrical lead means with its forward end located within said opening of said body such that said rear end of said body engages said shoulder of said ring means with said rear end of said ring means engaging said forward end of said fitting. A nut means is provided having an opening formed therethrough. Said nut means is located around said armored cable means and is adapted to be removably coupled to the rear end of said body. Said nut means has structure adapted to engage said shoulder of said fitting when said nut means is coupled to the rear end of said body and said forward end of said body is coupled to said connector whereby said fitting will be securely held between said ring means and said structure of said nut means. Said nut means is adapted to be uncoupled from said body and moved rearward thereby allowing said ring means to be removed. Said ring means is characterized such that it may be removed transversely from said electrical lead means.

In one embodiment, said ring means comprises a C-shaped member.

In another embodiment, said ring means comprises two half ring members adapted to be fitted together to form a ring.

DESCRIPTION OF THE PREFERRED EMBODIMENT

Figure 1:
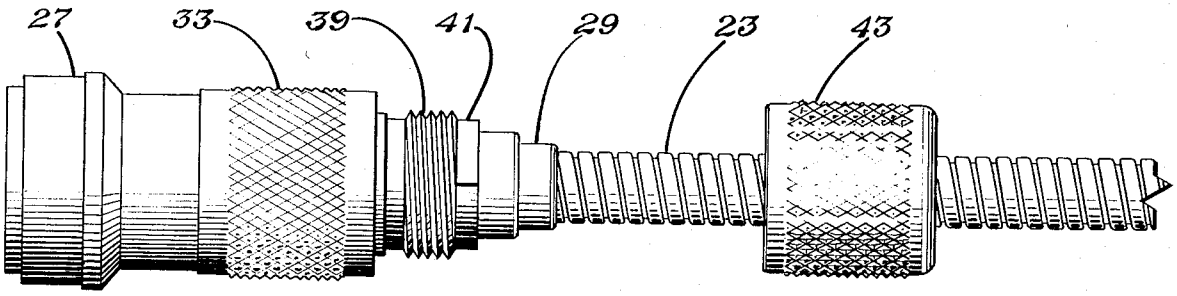
FIG. 1 is a side view of the electrical connector assembly of the present invention.
Figure 2:
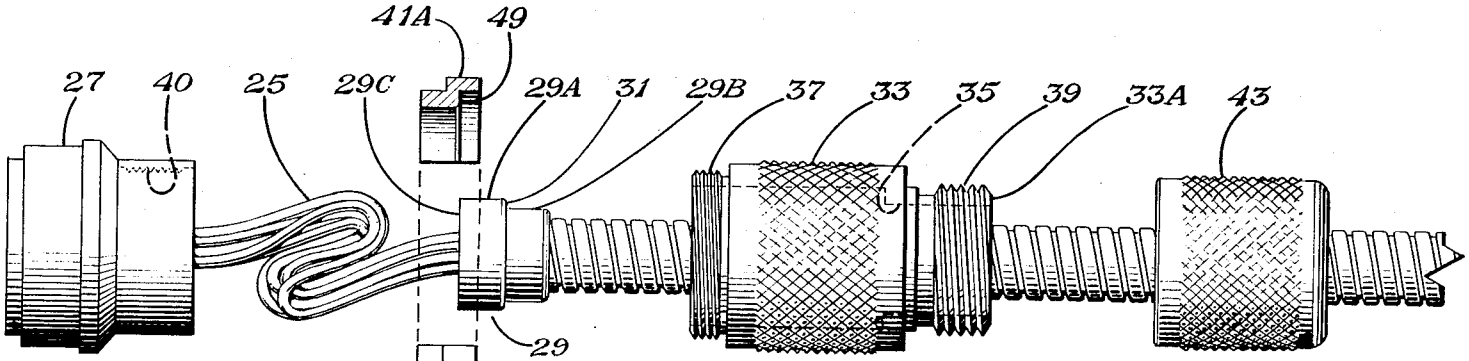
FIG. 2 is an exploded view of the assembly of FIG. 1.
Figure 3:
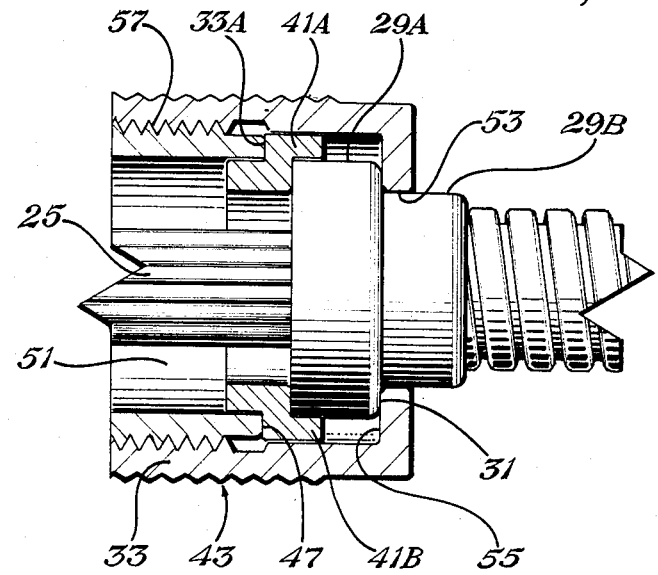
FIG. 3 is an enlarged cross-sectional view of the portion of the assembly of FIG. 1.
Figure 4:
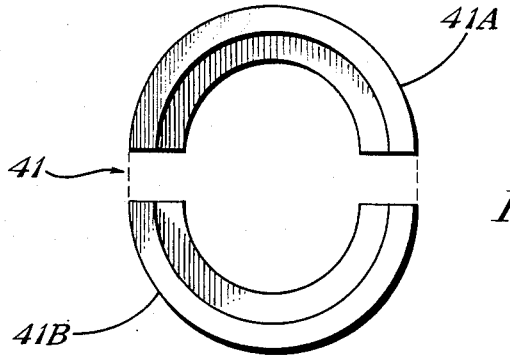
FIG. 4 illustrates a split ring used in the invention.

Referring now to the drawings, the connector assembly of the present invention is identified at 21 in FIGS. 1 and 2. It comprises a hollow armored cable 23 which carries a bundle of electrical leads 25, the forward portion of which extend out of the cable 23 and are connected to an electrical connector 27. The cable 23 is a commercially available bendable or flexible member formed of a helically wound wire strip. The connector 27 may be either a male or female connector with the individual wires of leads 25 connected to its male pins or female sockets respectively. The cable 23 has an annular fitting 29 connected to its end. The fitting 29 is described in detail in U.S. Pat. No. 4,295,672 which is herein incorporated by reference. The fitting 29 comprises a forward large diameter portion 29A and a rear smaller diameter portion 29B with a shoulder 31 formed therebetween. A tubular body 33 having an opening 35 formed therethrough has exterior threads 37 and 39 formed on its forward and rear ends respectively. The threads 37 of the tubular body 33 are screwed to interior threads 40 of the connector 27 when the body 33 is in an assembled position such that the body 33 surrounds the forward portion of the leads 25 with its rear end 33A forward of and near the forward end 29C of the fitting 29. The minimum diameter of the opening 35 is large enough such that the body 33 may be unscrewed from the connector 27 and moved rearward of the fitting 29 to a position around the cable 23. A split ring 41 comprising two half ring members 41A and 41B is provided in combination with a nut 43 for securely holding the fitting 29 and hence the cable 23 when the device is assembled. The ring 41 comprises a forward smaller diameter portion 44 and a larger rear diameter portion 45 with a shoulder 47 formed therebetween. The nut 43 is a cup shaped member with a larger inside diameter opening 51 and a smaller inside diameter opening 53 with a surface 55 formed therebetween. Interior threads 57 are formed in the wall of the nut 43 defining the larger opening 51 and are adapted to be screwed to the threads 39 of the tubular body 33. The diameter of the opening 53 is large enough to freely receive the cable 23 but is smaller than the diameter of the enlarged portion 29A of the fitting 29.

In assembling the device, the tubular body 33 is moved forward around the forward portion of the leads 25 and the threads 37 of the tubular body 33 are screwed into the threads 40 of the connector 27. The split ring members 41A and 41B are located around the leads 25 with their forward portions 44 inserted within the opening 35 of the tubular member 33 such that the rear end 33A of the tubular member 33 engages their shoulders 47. The rear ends 49 of the ring members 41A and 41B engage the forward end 29C of the fitting 29. The threads 57 of the nut 43 are screwed to the threads 39 of the tubular body 33 until the surface 55 of the nut 43 engages the shoulder 31 of the fitting 29. In this assembled position, the fitting 29 is securely held between the end 33A of the tubular body 33 and the ring 41 and the surface 55 of the nut 43.

In the disassembly of the device, the nut 43 is unscrewed from the tubular body 33 and moved rearward.

The connector 27 and tubular body 33 then can be moved forward relative to the fitting 29 due to the flexibility of the leads 25 allowing the split ring members 41A and 41B to be removed from the opening 35 of the tubular body 33 and then moved transversely away from the leads 25. The body 33 then can be unscrewed from the connector 27 and moved rearward of the fitting 29. This allows the wires of the leads 25 to be exposed so that the pins or socket members of the connector 27 can be readily inserted or removed from the connector 27 for assembly or disassembly purposes.

Figure 6:
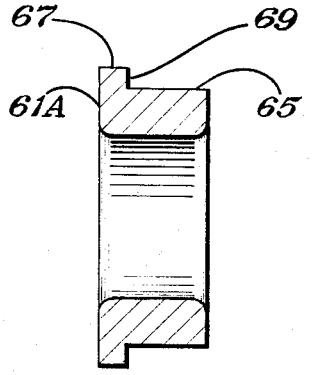
FIG. 6 is a view of FIG. 5 taken along the lines 6—6 thereof.
Figure 5:
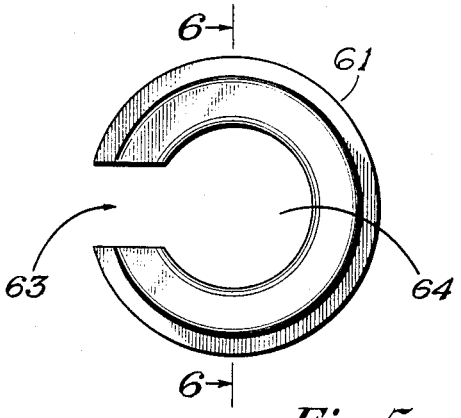
FIG. 5 is a C-shaped member used in the invention.

FIGS. 5 and 6 disclose another embodiment of a ring member which may be used in lieu of the split ring 41 in the event that the bundle of leads 25 is relatively small. In this embodiment, the ring member 61 comprises a washer having a slot 63 formed through one side forming a C-shaped member. The slot 63 is large enough to allow the bundle of wires 25 to pass through the slot 63 from the central opening 64 outward and vice versa. In cross section, the C-shaped member 61 comprises a forward smaller diameter portion 65 and a rear larger diameter portion 67 with a shoulder 69 formed therebetween. In assembly, the forward end of the tubular body 33 is screwed to the connector 27. The member 61 is located around the leads 25 by inserting the leads 25 through the slot 63 to the central opening 64 and the smaller diameter portion 65 inserted within the opening 35 of the tubular member until the rear end 33A of the tubular member 33 engages the shoulder 69. The rear end 61A of the member 61 then will engage the forward end 29C of the fitting 29. The nut 43 then is screwed to the rear end of the tubular body 33 until the shoulder 55 engages the shoulder 31 of the fitting 29. In the disassembly of the device, the nut 43 is unscrewed from the tubular body 33 and moved rearward. The connector 27 and tubular member 33 then are moved forward relative to the fitting 29 allowing the member 61 to be removed from the opening 35 of the tubular body 33. The member 61 then can be moved transversely away from the leads 25.

I claim:

1. An electrical cable connector assembly, comprising:

an electrical connector, a hollow armored cable means, a fitting having an opening formed therethrough connected to an end of said armored cable means, said fitting having an enlarged forward end and a rear end with a shoulder formed therebetween facing the rear of said fitting, electrical lead means extending through said armored cable means and through said fitting and coupled to said connector, a body having an opening formed therethrough, said body having a forward end adapted to be removably coupled to said connector and a rear end to be located near and forward of said forward end of said fitting when said forward end of said body is coupled to said connector, said electrical lead means extending through said opening of said body when said forward end of said body is coupled to said connector, said opening of said body being large enough such that said body may be moved rearward of said fitting when said forward end of said body is uncoupled from said connector, ring means having a forward end and an enlarged rear end with a shoulder formed therebetween facing said forward end of said ring means, said ring means having a rearward facing portion, said ring means being adapted to be located around said electrical lead means with its forward end located within said opening of said body such that said rear end of said body engages said shoulder of said ring means and with said rearward facing portion of said ring means engaging said forward end of said fitting, a nut means having an opening formed therethrough, said nut means being located around said armored cable means and adapted to be removably coupled to the rear end of said body, said nut means having structure adapted to engage said shoulder of said fitting when said nut means is coupled to the rear end of said body and said forward end of said body is coupled to said connector whereby said fitting will be securely held between said ring means and said structure of said nut means, said nut means being adapted to be uncoupled from said body and moved rearward thereby allowing said ring means to be removed, said ring means being characterized such that it may be removed transversely from said electrical lead means.

2. The electrical cable connector assembly of claim 1, wherein:

said ring means comprises a C-shaped member.

3. The electrical cable connector assembly of claim 1, wherein:

said ring means comprises two members adapted to be fitted together to form a ring.

4. The electrical cable connector assembly of claim 1, wherein:

said ring means comprises two half ring members adapted to be fitted together to form a ring.

* * * * *